United States Patent [19]

Slator

[11] 3,964,552

[45] June 22, 1976

[54] DRIVE CONNECTOR WITH LOAD COMPENSATOR

[75] Inventor: Damon T. Slator, Houston, Tex.

[73] Assignee: Brown Oil Tools, Inc., Houston, Tex.

[22] Filed: Jan. 23, 1975

[21] Appl. No.: 543,329

[52] U.S. Cl. ..... 173/164; 308/207 A

[51] Int. Cl.[2] ..... E21B 3/00

[58] Field of Search ..... 173/163, 164, 57, 20; 308/207 R, 222, 207 A, 202; 81/57.33, 57.34, 57.35, 57.15, 57.16; 175/85, 195

[56] References Cited

UNITED STATES PATENTS

| | | | |
|---|---|---|---|
| 3,312,294 | 4/1967 | Wilson | 173/164 |
| 3,706,347 | 12/1972 | Brown | 173/164 X |
| 3,744,577 | 7/1973 | Williams | 173/163 |
| 3,766,991 | 10/1973 | Brown | 173/20 |
| 3,776,320 | 12/1973 | Brown | 175/85 X |
| 3,867,989 | 2/1975 | Hisey et al. | 173/43 |

*Primary Examiner*—Ernest R. Purser
*Assistant Examiner*—Richard E. Favreau
*Attorney, Agent, or Firm*—Torres & Berryhill

[57] ABSTRACT

Disclosed is a rotary drive assembly for manipulating well pipe. The assembly, which is carried by the traveling block in a drilling derrick, provides means for engaging well pipe by either threaded or non-threaded connection. The threaded connection is used during drilling for imparting rotary motion to pipe forming a drill string. A torque-clamp, connector sub, and pipe guide combination provides male threads within a guiding surface to facilitate the threaded connection to pipe members. A break-out elevator provides a non-threaded connection which is used for manipulating pipe members and for making up or breaking out a connection between threaded pipe segments. A spring and roller assembly in the elevator facilitates the gripping of a pipe segment by the elevator and cushions the impact on the rotary drive assembly when the elevator is used to lift well pipe. Another spring and roller assembly in the drive head permits manual rotation of the drive connector to align the elevator for insertion or removal of a pipe segment.

22 Claims, 6 Drawing Figures

DRIVE CONNECTOR WITH LOAD COMPENSATOR

CROSS-REFERENCE TO RELATED APPLICATION

This application is related to U.S. Patent Application Ser. No. 477,028 filed June 6, 1974.

BACKGROUND OF THE INVENTION

1. Field of the Invention:

The present invention pertains generally to the drilling and completion of petroleum wells. More specifically, the invention pertains to a vertically movable, derrick-mounted driving apparatus for rotating a drill string and for manipulating pipe members being run into or removed from a well.

2. Brief Description of the Prior Art

In the conventional method of drilling wells, large internal combustion engines or other power sources are employed to rotate a rotary table set in the floor of a drilling derrick. Slidingly engaging a square hole in the rotary table is a square kelly member to which rotary motion is imparted by the table while the kelly is free to slide vertically therethrough. The lower end of the kelly is threadedly connected to the upper end of a string of drill pipe and the rotary motion is carried to a bit located at the lower end of the string.

As lengths of pipe are added to or removed from the drill string, it is necessary to employ auxiliary equipment such as wrenches, tongs, elevators, ropes, and chains to threadedly connect and disconnect the pipe members employed in the string. This technique, which is well known, is slow and extremely dangerous.

In U.S. Pat. Nos. 3,467,202; 3,774,697; 3,766,991; and 3,776,320 and in U.S. Pat. Application Ser. No. 418,065 filed Nov. 21, 1973 new and improved methods and apparatuses for drilling wells are disclosed in which the heavy rotary table, the chain drive connections, large internal combustion engines, tongs, spinning chains, manually set slips and other appurtenances of conventional well drilling equipment are eliminated. In these improved systems, a rotary power device, such as an electric motor, is supported from the traveling block of a drilling derrick for imparting rotary motion to the drill string. The rotary power device is equipped with a rotatable output shaft which may be provided with a threaded pin for connection to the upper end of a drill string.

U.S. Pat. No. 3,766,991 describes a connector device which may be connected to the output shaft of the power source to provide non-threaded engagement with the upper end of a pipe string. The connector includes a tubular housing adapted to coaxially receive the upper end of the pipe string and a set of pipe gripping shoes rockably mounted in the housing for angular movement into and out of gripping engagement with the upper end of the well pipe in accordance with the direction of angular movement of the housing relative to the pipe string. Thus, the pipe string may be rotated by the connector for drilling, or joints of pipe may be connected to and disconnected from the string as the string is run into or removed from the well.

U.S. Pat. No. 3,776,320 discloses an improved drive connector featuring a tubular housing having a longitudinal section removed therefrom to form a side opening through which a pipe member may be laterally placed in the housing. In many applications, this technique of encircling the pipe member with the connector may prove to be more convenient than the method of inserting the pipe member from the bottom of the connector, particularly where the pipe has an enlarged upset end.

U.S. Patent Application Ser. No. 477,028 filed June 6, 1974, discloses several methods for gripping pipe members in both side and bottom insertion elevators. Powered cocking cylinders also provide convenient lateral maneuvering of pipe members. A lost motion mechanism incorporated in the connector provides a jarring rotary impact to the elevator for breaking out pipe string joints.

In practice, the drive connector of the type herein described is massive and cumbersome. Therefore, the precise alignment of the elevator necessary for pipe manipulation may be a difficult operation. Also, the cam-operated gripping devices may be relatively sluggish and inefficient when applied to but a single pipe segment.

SUMMARY OF THE INVENTION

The drive head of the present invention is equipped with a pipe guide which assists in aligning the drive head for threaded connection to a pipe member. The guide is mounted on a connector sub which is locked to the drive head stem by a torque collar. The connector sub also provides a threaded pin, recessed within the guide, for union with the pipe member. Slots are formed in the guide so that an operator can see the threaded pin of the connector sub. This permits the operator to precisely control the vertical and rotary movements of the massive drive head as required to effect a mating with or release from the internally threaded box of a pipe member.

The break-out elevator is equipped with a roller and load-compensating spring assembly which increases the efficiency of the pipe gripping operation. The spring assembly collapses under the weight of a long drill string for proper load distribution in the elevator. A similar roller and spring assembly in the drive head allows manual alignment of the elevator, but also collapses appropriately when a great weight is supported by the elevator.

These and other features and advantages of the invention may be more fully appreciated by reference to the specification, the drawings and the related claims.

DESCRIPTION OF THE ILLUSTRATED EMBODIMENT

Figure 1:
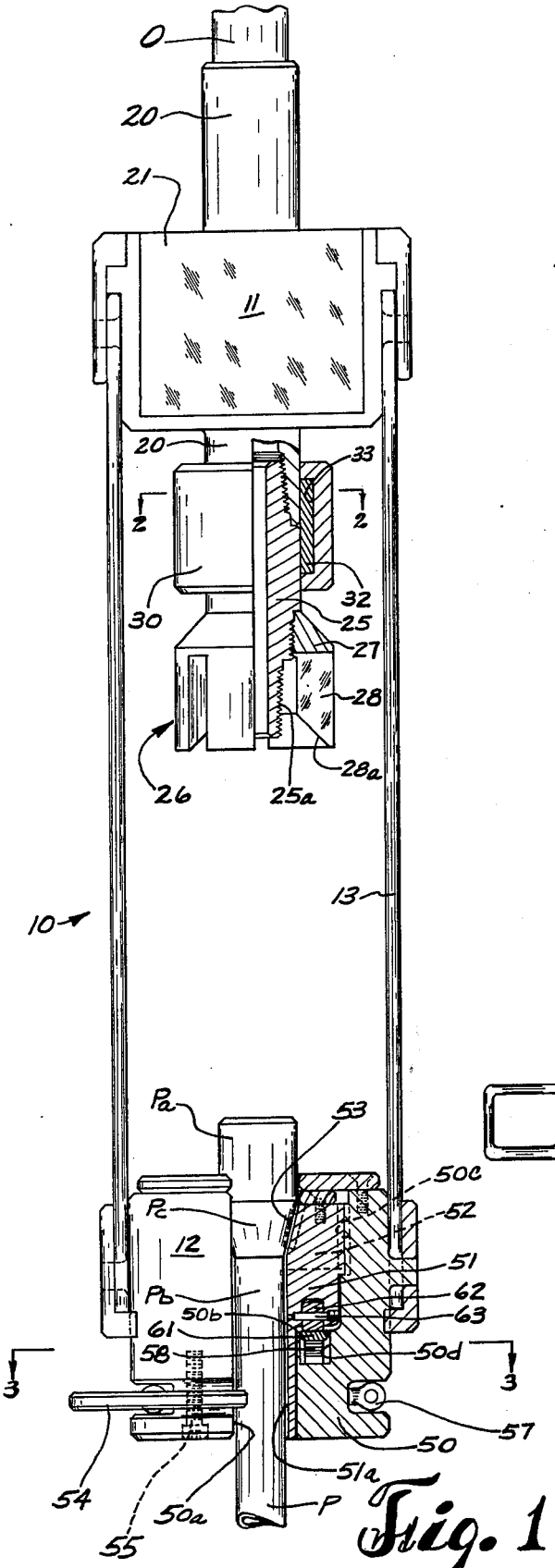
FIG. 1 is an elevation, in partial section, illustrating an exemplary embodiment of the drive connector assembly of the present invention.

The drive connector assembly of the present invention is illustrated generally at 10 in FIG. 1. The suspension of a drive connector assembly from the rotatable output shaft of a rotary power assembly to constitute a rotary drive assembly employed in a drilling derrick is discussed in U.S. Pat. Nos. 3,766,991 and 3,776,320. Details in the construction and operation of drive heads, breakout elevators, and bail suspension are also disclosed in the same patents, as well as in U.S. Patent Application Ser. No. 477,028 filed June 6, 1974.

As shown in FIG. 1, the drive connector includes a drive means or drive head 11 connected directly to the output shaft 0 of a rotary power assembly which is supported by a traveling block in a well derrick. The rotary power assembly, traveling block and well derrick are not shown in the drawings. A pipe gripper or elevator 12 is pivotably suspended by bails 13 from the drive head 11. The elevator 12 is illustrated gripping a pipe member P. Rotary and vertical movements of the drive head 11 are transmitted to the pipe member P as required to drill the well or to make-up or break-out pipe sections in a pipe string (not shown).

The drive head 11 includes a stem 20 which is joined directly to the output shaft 0 and extends below the drive head housing 21. As shown in FIG. 1, the lower extension of the stem 20 is internally threaded to receive a connector sub 25. The connector sub 25 provides external threads 25*a* for connection directly to the internal threads in the box Pa of a pipe member.

A pipe guide, shown generally at 26, is threadedly engaged to the connector sub 25. The guide 26 includes an annular base 27 and a plurality of appendages, or fingers, 28 with inwardly directed beveled guide surfaces 28*a*. The fingers 28 surround the lower portion of the sub 25 which is equipped with threads 25*a* for engaging pipe members or other well equipment. The beveled edges 28*a* of the fingers 28 are used to guide and centralize a pipe member for connection with the connector sub threads 25*a* when the pipe member is to be threadedly connected to the drive connector 10. The guide 26 is constructed with fingers 28 rather than in a solid annular form so that the operator may see the union between the sub 25 and the pipe P during the connection operation. The illustrated construction also reduces the weight of the guide 26.

A torque clamp 30 locks the connector sub 25 to the stem 20 to prevent relative rotation in the threaded joint between the stem and sub. Loosening of the sub 25 from the stem 20 might otherwise occur, for example, when the joint between the sub and a pipe member is being broken by reverse rotation of the stem.

Figure 2:
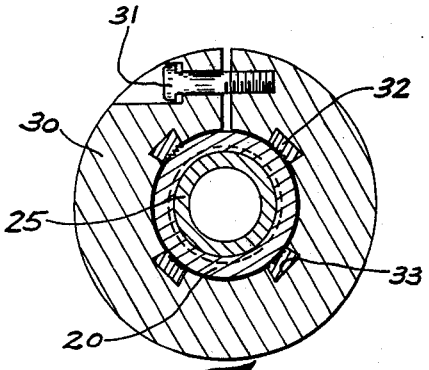
FIG. 2 is an enlarged horizontal cross-section taken along the line 2—2 of FIG. 1.

As shown in FIG. 2, the torque clamp 30 is in the form of a broken ring that is fitted about the stem 20 and sub 25. Two locking screws 31 (only one shown) are tightened across the break in the clamp 30, drawing the clamp into a locking friction fit on both the stem 20 and the sub 25. Four conventional slip dies 32, inserted in appropriate tongue-and-groove recesses 33 in the interior of the torque clamp 30, grip the stem 20 and sub 25 in a locking configuration. Each slip die 32 is faced with a series of sharp vertical edges or teeth that press against the stem 20 and sub 25 in the locking configuration to prevent rotational slipping of the stem and sub with respect to the torque clamp. In this manner, both the stem 20 and the sub 25 are rotationally locked to the torque clamp 30, and, therefore, to each other.

Figure 3:
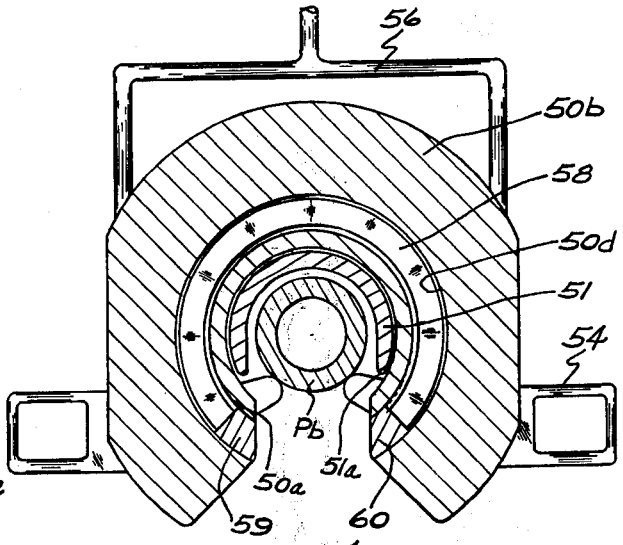
FIG. 3 is an enlarged horizontal cross-section taken along the line 3—3 of FIG. 1.

The break-out elevator 12 illustrated in FIGS. 1 and 3 is a side-insert, or "open-faced", elevator. The elevator 12 includes a generally tubular housing 50 with a side opening 50*a* for insertion of the narrow trunk Pb of a pipe member P, a slip mount 51 rotatably supported ultimately by an internal housing 50*b*, cam shoes 52 fitted in appropriate slots in the slip mount, and a slip die 53 in each cam shoe. The pipe member P is supported by a frusto-conical segment Pc which rests on the inclined slip dies 53. When rotational motion is imparted to the elevator 12, through the bails 13 by the output shaft 0 and the drive head 11, the initial drag of the pipe member P exerted on the cam shoes 52 through the slip dies 53 causes rotational motion of the cam shoes with respect to the elevator housing 50. Camming surfaces 50*c* on the tubular housing 50 behind the cam shoes 52 then force the cam shoes inwardly as the shoes ride around the camming surfaces. The camming surfaces 50*c* comprise smooth surfaces which, in the vertical direction, are parallel with the central axis of the housing 50 and, in the horizontal direction, curve inwardly from a central point toward the housing axis, whereby relative rotational movement between the housing and the cam shoes 52 causes the cam shoes to advance radially toward the central housing axis as the cam shoes slide along the camming surfaces. The elevator 12 thus includes radially movable gripping means for selectively gripping well equipment engaged by the elevator. The camming action also functions to increase the gripping force as relative rotational forces between the gripped equipment, or pipe P, and the elevator 12 increase. The inclination of the slip dies 53 produces a wedging effect with the pipe area Pc which produces an increase in the gripping force exerted by the elevator as the downwardly directed force on the pipe P increases. This latter effect also assists in preventing relative rotational movement between the pipe P and the elevator 12. Additional details present in a cam surface and shoe arrangement suitable for the assembly of the present invention may be obtained by reference to U.S. Pat. No. 3,776,320 and U.S. Patent Application Ser. No. 477,028 filed June 6, 1974.

When moved radially inwardly by the camming surfaces 50*c*, the slip dies 53 grip the pipe member P for imparting to it the rotational motion of the housing 50. Latch bars 54, mounted on pivot pins 55 in the housing 50, serve the dual purpose of retaining the pipe member P within the housing opening 50*a* (closed position) and of aligning a similar opening in the slip mount 51*a* with the housing opening 50*a* (open position). Such alignment is necessary to permit insertion or removal of the pipe member P through the side opening. The latch bars 54 are operable manually as well as by fluid pressure supplied by a fluid pressure line 56 to two conventional fluid pressure ram and cylinder assemblies 57 attached to the latches. Additional information regarding the latches, cylinders and other aspects of the elevator 12 may be obtained by reference to U.S. Pat. No. 3,776,320 and U.S. Patent Application Ser. No. 477,028 filed June 6, 1974.

Figure 4:
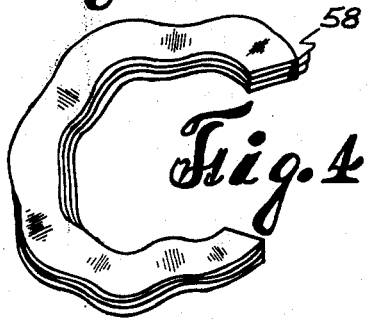
FIG. 4 is a perspective view illustrating three springs, in relaxed condition, from the spring assembly of the invention.

The present invention includes an improvement in the rotatable support of the slip mount 51 by the housing shoulder 50*b* in the form of a load compensating device. A plurality of springs 58 lies in a partially annular recess 50*d* in the housing shoulder 50*b* and is interposed between the housing and ultimately the slip mount 51. As shown in FIGS. 1, 3 and 4, each spring 58 is a partially circular collar, pressed into an undulating profile. In practice, each spring 58 is made by removing the appropriate arc segment from a commercially-available Bellville washer spring. A laminated assembly is formed by stacking the springs 58 so that their respective undulations fit each other smoothly. The whole assembly of springs 58 is kept from rotatably sliding out of the recess 50*d* into the housing side opening 50*a* by keeper blocks 59 and 60 welded into place to close off the ends of the recess 50*d*. A partially circular raceway 61 is supported by the springs 58. The raceway 61, in turn, supports a plurality of roller bearings 62 mounted on shafts 63 in the slip mount 51. The weight of the pipe member P, and whatever is attached thereto, is borne by the rotary drive assembly through the slip dies 53, slip mount 51, shafts 63, roller bearings 62, raceway 61, springs 58, elevator housing 50, bails 13, and drive head 11. Any weight or downward shock on the rotary drive assembly, applied through the pipe member P, is thus cushioned by the springs 58. Such load compensation decreases the wear on components and prolongs the life of the drilling system.

In order for the cam shoes 52 to be forced radially inwardly by the camming surfaces 50*c*, the slip mount 51, in which the cam shoes are mounted, must rotate relative to the tubular housing 50 under the influence of the frictional drag exerted on the slip dies 53 by the pipe member P. Therefore, the frictional drag between the pipe member P and the slip dies 53 must be greater than the corresponding rotational forces between the slip mount 51 and the tubular housing 50. These latter forces are minimized by the use of the roller bearings 62. The weight of a single pipe segment P, or even of a three-segment pipe stand, is insufficient to collapse the springs 58 to the point where the slip mount 51 rests directly on the housing shoulder 50*b*, alongside the annular recess 50*d*. Thus, as long as no more than a single pipe stand is supported by the elevator 12, the slip mount 51 is relatively free to rotate with respect to the tubular housing 50 until the camming action locks the slip dies 53 to the pipe member P and the cam shoes 52 against the camming surfaces 50*c*. Such relative freedom of rotational motion of the slip mount 51 with respect to the tubular housing 50 is also required in aligning the slip mount opening 51*a* with the housing side opening 50*a* to insert or remove a pipe member P as noted hereinbefore.

When the elevator 12 is supporting a pipe string, as in the case, for example, when a pipe string is being withdrawn from the well and broken out, the weight of the pipe string collapses the springs 58 and causes the slip mount 51 to rest directly on the housing shoulder 50*b*. Then, the weight of the pipe string is supported by the tubular housing 50 directly through the slip mount 51 rather than indirectly through the roller bearings 62. This reduces the wear on the roller bearings 62, and provides for a continuous distribution of load along the housing shoulder 50*b* rather than only at the points of contact made with the roller bearings. When the weight of the pipe string is picked up by other equipment at the well head, and just one pipe segment or a pipe stand is to be supported by the elevator, the springs 58 raise the slip mount 51 off of the housing shoulder 50*b* to permit use of the roller bearings 62 to accomplish the desired rotational motion between the slip mount and the tubular housing 50. Then, the elevator 12 can be rotated and the pipe member P gripped as described hereinbefore, and the joint between the pipe member and the rest of the pipe string broken. It will be appreciated that, when the pipe string is supported by the elevator 12, and the springs 58 are collapsed, no torque forces are required to be applied by the elevator to the pipe member P which is inserted within the elevator, nor does the slip mount opening 51*a* have to be aligned with the housing side opening 50*a*. Therefore, in such a situation, no relative rotational motion is needed between the slip mount 51 and the tubular housing 50, nor are the roller bearings 62, which are then incapacitated, needed to reduce the frictional forces between the slip mount and the tubular housing 50.

Figure 5:
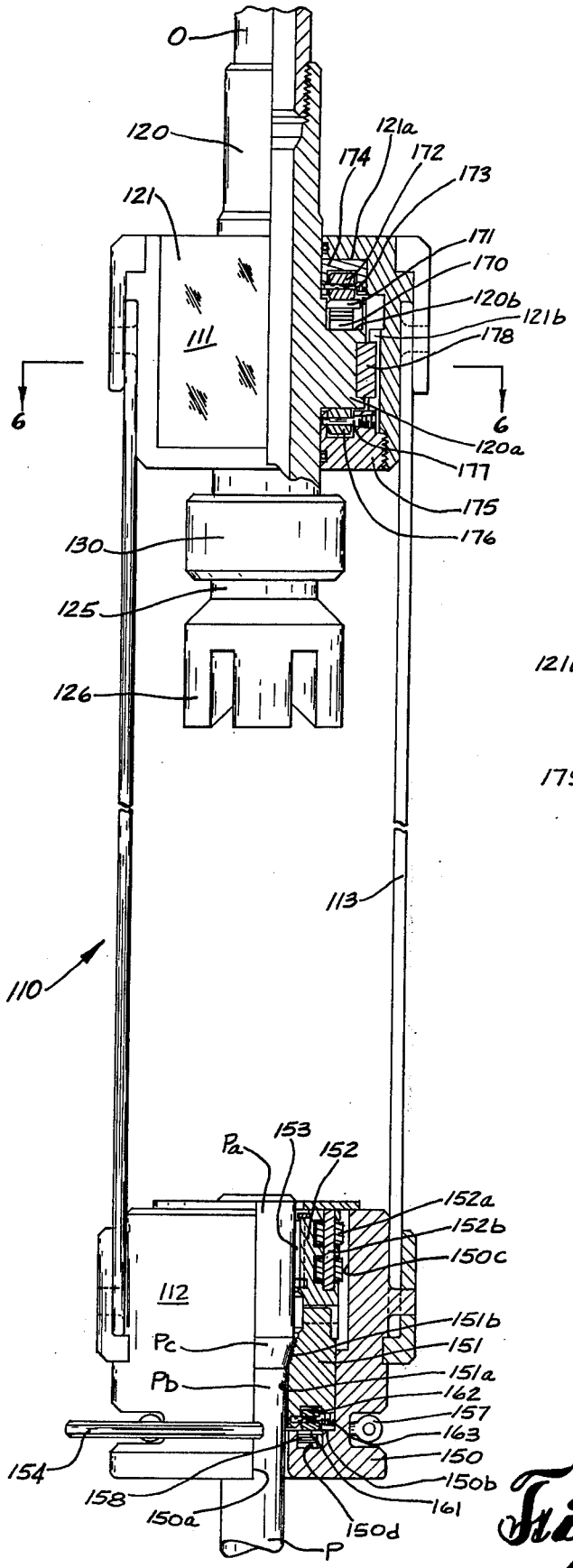
FIG. 5 is an elevation, in partial section, illustrating another embodiment of the drive connector assembly of the present invention.

Another embodiment of the drive connector is shown generally at 110 in FIG. 5. As in FIG. 1, a drive head 111 is connected directly to the output shaft 0 of a rotary power assembly (not shown), and an elevator 112 is supported by bails 113 from the drive head 111. The drive head 111 includes a stem 120 which is joined directly to the output shaft 0 and extends below the drive head housing 121. A connector sub 125, pipe guide 126, and torque clamp 130 are suspended below the drive head 111 as discussed hereinbefore in relation to FIGS. 1 and 2.

The break-out elevator 112 is a side-insert elevator that differs from the elevator 12 in FIGS. 1, 3 and 4 primarily in the pipe-support and pipe-grip mechanisms. The elevator 112 includes a generally tubular housing 150 with a side opening 150*a* for inserting the narrow trunk Pb of a pipe member P, a slip mount 151 rotatably supported ultimately by an internal housing shoulder 150*b*, cam shoes 152 fitted in appropriate generally horizontal T-slots in the top of the slip mount, and two slip dies 153 in each cam shoe. The radially-outward side of each cam shoe 152 is equipped with a pair of rollers 152*a*, mounted on a shaft 152*b* set in the cam shoe. The pipe member P is supported by its frusto-conical segment Pc which rests on a matching inclined surface 151*b* on the slip mount 151. When rotational motion is imparted to the elevator 112, through the bails 113 by the output shaft 0 and the drive head 111, the initial drag of the pipe member P exerted on the frusto-conical surface 151*b* of the slip mount 151 causes rotational motion of the cam shoes with respect to the elevator housing 150. Camming surfaces 150*c* on the tubular housing 150 behind the cam shoes 152 then force the cam shoes inwardly as the shoes ride around the camming surfaces on the rollers 152*a*. As described hereinbefore in relation to FIG. 1, relative rotational motion between the elevator housing 150 and the cam shoes 152 causes the cam shoes to advance radially toward the central housing axis as the shoes roll around the camming surface 150*c*. The elevator 112 thus includes radially movable gripping means for selectively gripping well equipment engaged by the elevator.

Latch bars 154, operated manually or through two conventional fluid pressure ram and cylinder assemblies 157 attached to the latches, serve the dual purpose of retaining the pipe member P within the housing opening 150*a* (closed position) and of aligning a similar opening in the slip mount 151*a* with the housing opening 150*a* (open position) as described hereinbefore in relation to the embodiment in FIGS. 1, 3, and 4.

A laminated assembly of springs 158, identical to the springs 58 shown in FIG. 4, is positioned in a partially annular recess 150*d* in the housing shoulder 150*b*, and supports a partially circular raceway 161. The raceway 161, in turn, supports a plurality of roller bearings 162, mounted on shafts 163 in the slip mount 151. The spring assembly 158 acts in the manner of the spring assembly 58 in FIGS. 1, 3 and 4 to raise the slip mount 151 off of the housing shoulder 150*b* when no more than a single pipe stand is supported by the elevator 112, thus allowing the rotational drag of the slip mount 151 on the elevator housing 150 to be minimized. When a greater weight, such as the weight of a pipe string, is supported by the elevator 112, the spring assembly 158 collapses, allowing the slip mount 151 to come into direct contact with the housing shoulder 150*b*, removing the load from the roller bearings 162.

The stem 120 of the drive head 111 is equipped with a shoulder 120*a* that is overlapped by a shoulder 121*a* of the drive head housing 121. A laminated assembly of Bellville washer springs 170 is situated within an annular recess 120*b* in the top of the stem shoulder 120*a*, and supports an annular raceway 171. A plurality of roller bearings 172, mounted on shafts 173 within an annular ring 174, rides on the raceway 171. The drive head housing shoulder 121*a* rests on the top of the ring 174. The load of the elevator 112 is supported through the bails 113 by the drive head housing 121, the ring 174, and the stem shoulder 120*a*. When the elevator load is large, for example when a pipe string is being supported, the spring assembly 170 collapses and the ring 174 contacts the stem shoulder 120*a* directly, leaving the roller bearings 172 load-free. When the load on the elevator 112 is light, as in the case when no more than a pipe stand is being supported, the spring assembly 170 raises the ring 174 off of the stem shoulder 120*a*, placing the load on the roller bearings 172 and allowing relative rotational motion between the drive head housing 121 and the stem 120.

A collar 175 is threadedly engaged in the bottom of the drive head housing 121. A plurality of roller bearings 176, mounted on shafts 177 which are fitted in the collar 175, limits the downward motion of the stem 120 with respect to the drive head housing 121, while permitting relative rotational motion of the stem with respect to the collar.

Figure 6:
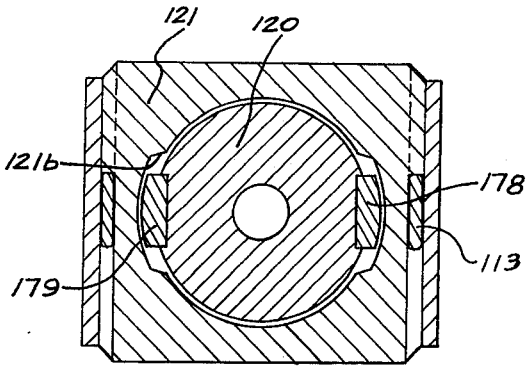
FIG. 6 is a horizontal cross-section taken along the line 6—6 of FIG. 5.

The stem shoulder 120*a* is fitted with two keys 178 and 179, as seen in FIG. 6. The generally tubular design of the drive head housing 121 permits rotational motion of the stem 120 with respect to the drive head housing. The cavity of the drive head housing 121, however, is fitted with four vertically-running stops 121*b*. The keys 178 and 179 protrude radially from the stem shoulder 120*a* to contact the stops 121*b* as the stem 120 is rotated with respect to the drive head housing 121. Thus, the rotational motion of the stem 120 with respect to the drive head housing 121 is limited to a rotational angle of about 45°. This limited rotation feature serves two purposes. In the operation of using the elevator 112 to manipulate a single pipe member or a pipe stand, it is necessary to control the orientation of the elevator housing opening 150*a*. When the spring assembly 170 is expanded so that the elevator load is supported by the roller bearings 172, the drive head housing 121, with the bails 113 and the elevator 112 attached, may be manually rotated with respect to the stem 120 through the 45° angle. In this way, the elevator housing opening 150*a* may be manually aligned for the insertion or release of a pipe member in a particular direction. When the elevator 112 is being used to break-out a pipe joint between a pipe member P gripped in the elevator and another pipe member held by other equipment, the ability of the stem 120 to be rotated 45° with respect to the drive head housing 121 operates as a lost-motion device to provide a jarring action when the keys 178 and 179 abruptly come in contact with the stops 121*b*. This jarring action can be used to overcome the initial tightness of the pipe joint to be broken-out.

It will be appreciated that the spring and roller assemblies of the present invention may be used in any appropriate combination of drive head and elevator.

The foregoing disclosure and description of the invention is illustrative and explanatory thereof, and various changes in the sizes, shape and materials, as well as in the details of the illustrated construction may be made within the scope of the appended claims without departing from the spirit of the invention.

I claim:

1. A well drilling or completion system for manipulating well equipment comprising:
   a. a power drive assembly for providing rotary and vertical movement in a well derrick;
   b. a longitudinally extending output shaft means rotatably powered by said power drive assembly and movable vertically therewith;
   c. a connector assembly carried by said power drive assembly and rotatably powered thereby, for carrying and supporting weight of said well equipment;
   d. elevator means included in said connector assembly for engaging said well equipment; and
   e. load compensating means included in said connector assembly for cushioning and supporting said weight of said well equipment supported by said connector assembly.

2. A well drilling or completion system as defined in claim 1 wherein said load compensating means further comprises elastic spring means deformable by said weight of said well equipment supported by said connector assembly to thereby cushion and support said weight by elastic forces of said deformed elastic spring means.

3. A well drilling or completion system as defined in claim 1 further comprising:
   a. threaded connection means included in said connector assembly for threadedly engaging well equipment; and
   b. guide means adjacent said threaded connection means for facilitating the alignment of said threaded connection means with said well equipment for threaded engagement therebetween.

4. A well drilling or completion system as defined in claim 3 wherein said guide means further comprises a plurality of circumferentially spaced appendages arranged concentrically about said threaded connection means.

5. A well drilling or completion system as defined in claim 4 wherein said load compensating means further comprises elastic spring means deformable by said weight of said well equipment supported by said connector assembly to thereby cushion and support said weight by elastic forces of said deformed elastic spring means.

6. A well drilling or completion system as defined in claim 1 wherein:
   a. said elevator means comprises well equipment supporting means and elevator housing means; and
   b. said load compensating means is interposed between said elevator housing means and said well equipment supporting means.

7. A well drilling or completion system as defined in claim 6 wherein:
   a. said well equipment supporting means comprises slip die means fixed in cam shoe means mounted in slip mount means for gripping a pipe member; and
   b. said load compensating means further comprises spring means carried in said elevator housing means and which is deformable under sufficient weight of said well equipment on said elevator means to allow direct contact between said elevator housing means and said well equipment supporting means.

8. A well drilling or completion system as defined in claim 7 further including:

a. threaded connection means included in said connector assembly for threadedly engaging well equipment; and b. guide means adjacent said threaded connection means for facilitating the alignment of said threaded connection means with said well equipment for threaded engagement therebetween.

9. A well drilling or completion system as defined in claim 8 wherein said guide means further comprises a plurality of circumferentially spaced appendages arranged in cylindrical symmetry concentrically about said threaded connection means.

10. A well drilling or completion system as defined in claim 1 further including in said connector assembly:

a. drive head means connected to and rotatably carried by said output shaft; and b. bails carried by said drive head means and pivotally secured to said elevator means.

11. A well drilling or completion system as defined in claim 10 wherein said elevator means includes radially movable gripping means for selectively gripping well equipment engaged by said elevator means.

12. A well drilling or completion system as defined in claim 11 wherein said gripping means includes rotary camming means for increasing the radially directed gripping forces exerted on said equipment by said gripping means as the forces tending to rotate said equipment and said elevator means relative to each other increase.

13. A well drilling or completion system as defined in claim 12 wherein said elevator means includes:

a. elevator housing means having a side access opening for receiving equipment within said elevator housing means; and b. powered latch means for opening or closing said access opening as required to admit or retain equipment within said elevator housing means.

14. A well drilling or completion system as defined in claim 13 wherein:

a. said elevator housing means includes shoulder means provided with groove means;

b. said load compensating means further comprises spring means located in said groove means; and c. said gripping means is supportable by said spring means.

15. A well drilling or completion system as defined in claim 14 further comprising:

a. threaded connection means included in said connector assembly for threadedly engaging well equipment; and b. guide means adjacent said threaded connection means for facilitating the alignment of said threaded connection means with said well equipment for threaded engagement therebetween.

16. A well drilling or completion system as defined in claim 15 wherein said guide means further comprises a plurality of circumferentially spaced appendages arranged in cylindrical symmetry concentrically about said threaded connection means.

17. A well drilling or completion system as defined in claim 10 wherein:

a. said drive head means comprises drive head housing means and drive connector support means connecting said drive head housing means to said output shaft means; and b. said load compensating means is interposed between said drive head housing means and said drive connector support means.

18. A well drilling or completion system as defined in claim 17 wherein said load compensating means further comprises spring means carried in said drive head housing means and which is deformable under sufficient weight of said well equipment on said elevator means to allow direct contact between said drive head housing means and said drive connector support means.

19. A well drilling or completion system as defined in claim 18 wherein:

a. said elevator means comprises well equipment supporting means and elevator housing means; and b. said load compensating means is also interposed between said elevator housing means and said well equipment supporting means.

20. A well drilling or completion system as defined in claim 19 wherein:

a. said well equipment supporting means comprises slip die means fixed in cam shoe means mounted in slip mount means for gripping a pipe member; and b. said load compensating means further comprises spring means carried in said elevator housing means and which is deformable under sufficient weight of said well equipment on said elevator means to allow direct contact between said elevator housing means and said well equipment supporting means.

21. A well drilling or completion system as defined in claim 20 further including:

a. threaded connection means included in said connector assembly for threadedly engaging well equipment; and b. guide means adjacent said threaded connection means for facilitating the alignment of said threaded connection means with said well equipment for threaded engagement therebetween.

22. A well drilling or completion system as defined in claim 21 wherein said guide means further comprises a plurality of circumferentially spaced appendages arranged in cylindrical symmetry concentrically about said threaded connection means.

* * * * *

UNITED STATES PATENT AND TRADEMARK OFFICE

CERTIFICATE OF CORRECTION

PATENT NO. :3,964,552
DATED :6/22/76
INVENTOR(S) : DAMON T. SLATOR

It is certified that error appears in the above-identified patent and that said Letters Patent are hereby corrected as shown below:

In Column 4, line 2, after ..housing.., insert the word ---shoulder--.

In Column 5, line 65, after the word ..string.., insert the word --weight--.

In Column 6, line 48, delete the word "surface", and insert therefor --surfaces--.

Signed and Sealed this

Thirtieth Day of November 1976

[SEAL]

*Attest:*

RUTH C. MASON
*Attesting Officer*

C. MARSHALL DANN
*Commissioner of Patents and Trademarks*